United States Patent [19]

Guliker

[11] Patent Number: 4,964,252

[45] Date of Patent: Oct. 23, 1990

[54] JOINING SYSTEM FOR JOINING WALL PANELS TO FORM A BOX-LIKE HOUSING

[75] Inventor: Hendrik J. Guliker, Putten, Netherlands

[73] Assignee: Fokker Special Products B.V., Netherlands

[21] Appl. No.: 426,099

[22] Filed: Oct. 24, 1989

[30] Foreign Application Priority Data

Oct. 25, 1988 [NL] Netherlands ..... 8802624

[51] Int. Cl.[5] ..... E04B 1/00

[52] U.S. Cl. ..... 52/275; 52/282; 52/285; 220/1.5

[58] Field of Search ..... 52/258, 259, 416, 417, 52/421, 284–286, 275, 276, 282; 220/1.5, 4 F, 76, 3.1

[56] References Cited

U.S. PATENT DOCUMENTS

| | | | |
|---|---|---|---|
| 3,316,460 | 4/1967 | Scoville | 220/4 F X |
| 3,655,087 | 4/1972 | Luisada | 220/4 F X |
| 3,862,297 | 1/1975 | Claridge | 423/615 |
| 3,988,869 | 11/1976 | Tuttle | 52/285 |
| 4,020,611 | 5/1977 | Amos | 52/417 X |
| 4,261,148 | 4/1981 | Scott | 52/285 |
| 4,689,930 | 9/1987 | Menchetti | 52/275 X |
| 4,691,483 | 9/1987 | Anderson | 52/79.1 |
| 4,748,790 | 6/1988 | Frangolacci | 52/809 |
| 4,840,440 | 6/1989 | Dieter | 52/285 X |

FOREIGN PATENT DOCUMENTS

| | | | |
|---|---|---|---|
| 531202 | 9/1954 | Belgium | 52/276 |
| 2613675 | 10/1977 | Fed. Rep. of Germany | 52/282 |
| 2914920 | 10/1979 | Fed. Rep. of Germany | 52/259 |
| 2194682 | 3/1988 | United Kingdom . | |
| 2194683 | 3/1988 | United Kingdom . | |

*Primary Examiner*—David A. Scherbel
*Assistant Examiner*—Lan Mai
*Attorney, Agent, or Firm*—Handal & Morofsky

[57] ABSTRACT

Joining system for joining wall panels to form a box-like housing, which panels are composed of rectangular flat plates having a core of electrically non-conducting material and having two principal surfaces situated opposite each other and covered by a layer of electrically conducting material. In the peripheral surfaces a groove extends parallel to the said principal surfaces. The groove walls are embodied such that the two principal surfaces of each plate each terminate in a wedge-shaped peripheral portion along the edges. The panels have to be joined to each other in tows by means of two L-shaped sections of electrically conducting material of which the ends of both legs are provided with a groove whose cross-sectional shape is matched to the shape of the wedge-shaped peripheral portions. The wedge-shaped peripheral portions of the panels are pushed into the grooves in the ends of the legs of two suitably dimensioned L-shaped sections to produce the joint between two panels and the panels subsequently are pressed with force into the said grooves in the L-shaped sections.

9 Claims, 2 Drawing Sheets

JOINING SYSTEM FOR JOINING WALL PANELS TO FORM A BOX-LIKE HOUSING

The invention relates to a joining system for joining wall panels to form a box-like housing.

A specific field of application of such box-like and, in general, transportable, housings is the housing of the electronic equipment which forms part of a weapon system. Such a housing is known as a "shelter". Owing to its specific qualities, the "shelter" is equally suitable as a work place for all kinds of non-military activities. In the past 15 to 20 years, a substantial market has arisen for such box-like cabins or housings. In particular, for the abovementioned uses, the design and the construction of the housing has to conform to military product specifications such as, for example, are to be found in the U.S. publication MIL-STD-907B dated Sept. 9, 1985 and entitled "Military Standard Engineering and Design Criteria for Shelters, Expandable and Non-expandable". The requirements stated therein are determined by the wide variety of operational circumstances in which a weapon system may find itself. On the one hand, said requirements relate to the screening of electromagnetic radiation, in particular high-frequency radiation, lightning strike and circumstances associated with nuclear/bacteriological/chemical warfare. On the other hand, these requirements are directed at the mechanical design of the box-like housing, an effort being made to a considerable extent to standardize similar housings. In relation to the mechanical requirements, it is pointed out that such a box-like housing has to be suitable for transport by road and by air. The entire shelter, including the contents contained therein, must be capable of being lifted up and lashed down.

The use of such box-like housings or shelters within military environments is described, inter alia, in Military Technology, July 1987, pages 26–35 and Wehr Technik, February 1987, pages 26–32. Patent publications which describe relevant prior art are, inter alia, U.S. Pat. Nos. 3,862,297, 3,988,969, 4,691,483, 4,748,790 GB Nos. 2,194,682 and 2,194,683.

From the publications mentioned it is reasonable to deduce that the present generation of such box-like housings or shelters which conform to the highest military requirements are in general constructed from flat panels composed of a core of foamed plastic material having a thickness of a few centimeters (for example 5 cm) between two thin metal or metallized plastic plates. The panels preferably do not have any assembly divisions. In other words, each wall of such a shelter is formed by an integral, undivided panel. The panels adjoining one another at the side edges of the shelter are mutually joined with the aid of extruded frame sections. In order to safeguard the electrical systems in the shelter by means of a Faraday cage against external influences, the outside surfaces of the panels are joined to one another via said frame sections in a manner such that an electrically conducting joint is produced which is such that an entirely continuous, electrically conducting surface is achieved on the shelter. One and the same joint is also brought about on the inside surface of the panels.

In order to avoid a cold bridge, the section which is used to join the outside surfaces is kept thermally insulated from the frame section which achieves the joint to the inside surfaces. The further choice of joining means by which wall panels and frame sections are secured to one another is dominated by the requirements to which the housing has to conform in relation to the strength, dimensional stability, gastightness, thermal insulation and the like. The literature data reveal that the requirements set are so high that a combination of bonded and riveted joints appears to form an ideal choice. The high-quality types of structural adhesive used are usually identical to the types of adhesive which are used in aircraft construction. A drawback of adhesive bond is that, as a result of the thickness of the bond layer, there is no possibility of metallic contact between the metal or metallized wall surface of a panel and the frame section with which the joint to an adjacent panel is achieved. The contact therefore has to be brought about by providing an adequate number of metal blind rivets in the strips of adhesive on the inside and outside of the housing. For the normal outside dimensions of military shelters of 2.5×2.5×7 meters the provision of the blind rivets in a double row with a pitch of 50 mm is a very labor-intensive job. A second drawback of the bonded joint is that, as a result of the space occupied by the bond layer, there is a certain gap between the metal outside layer of a panel and the metal frame section, and this results in a leak in the Faraday cage. One and the same shortcoming is also exhibited by a joint which is achieved entirely with the aid of bolts, because deformation of the material will in general occur between the successive bolts. Although increasing the number of bolts or blind rivets will improve the sealing, it also results in a substantially more labour-intensive assembly.

The gap which is produced by a bonded joint can be screened still further by applying, after a careful pretreatment of the metal surface, for example, an electrically conducting plastic paste to the junction between the frame section and the metal surface of a panel both on the inside and on the outside. A known means in this connection is the paste of the type Eccoshield VY-NN supplied by Emerson and Cuming Europe N.V.

In the case of a joint which is achieved entirely with the aid of bolts, said paste will be applied in the joint. The junction between the frame sections and the panels themselves should also be well sealed in order to protect the bare metal against the corrosive environment in which the shelter is placed.

A Faraday cage constructed in this manner has, in general, an adequate screening for high-frequency electromagnetic energy of the type which is produced by radio installations, radar installations and the like. The electromagnetic energy which is released during nuclear explosions or is present in the high-energy high-frequency radar which is used as military target tracking radar will, however, penetrate through small gaps which are encountered and which are left over by the paste joint. Small openings may arise during the service life of the shelter as a result of the paste becoming unstuck. The energy permeating will have to be attenuated. The attenuation of EMP energy, the energy released during nuclear explosions, will, however, be insufficient to prevent some of said energy penetrating through the gap. The penetrating part will have to be attenuated still further by the internal design ofo the panel. Adequate attenuation thereof can be expected only if the panel contains a labyrinth. Labyrinth-type designs are disclosed, for example, in the British publications GB Nos. 2,194,682 and 2,194,683 already mentioned.

From the abovementioned literature references it is furthermore clearly evident that such shelters are in general provided with corner fittings which, on the one hand, serve to mutually couple the frame sections which come together at each corner point and which are furthermore provided with crane hooks or attachment means with which the shelter can be lifted, transported etc. as a whole. The crane hooks are in general provided in a countersunk manner. The design as a whole has to be such that a specified external test load on any corner fitting does not leave behind any permanent damage to the structure of the housing.

In view of the relatively labor-intensive assembly of the shelters known per se, a first object of the invention is to provide a joining system for prefabricated wall panels and frame sections with which the assembly time needed and consequently the processing time within an assembly line can be shortened substantially. A further object of the invention is to provide a joining system between wall panels and frame sections in which bonded joints, bolts or blind rivets are not, in principle, necessary. A third object of the invention is to provide a joining system such that not only can a mechanically rigid, gastight and thermally insulated, box-like housing be achieved, but also a double Faraday cage with good conduction can be formed which does not contain any possible leakage positions.

A fourth object of the invention is to thermally insulate the inside wall with respect to the outside wall. The insulation is necessary in order to maintain a certain temperature in the shelter regardless of the outside temperature.

A fifth object of the invention is to provide a dismantable shelter. This property may be of importance in replacing damaged parts or if, for example, a continuous wall has to be replaced by a wall having a door or a hatch.

According to the invention, these objectives are met by a joining system for joining wall panels to form a box-like housing, which panels are composed of rectangular flat plates having a core of electrically non-conducting material and having two principal surfaces situated opposite each other and four peripheral surfaces, a layer of electrically conducting material being provided on each of the principal surfaces, while there is provided in the peripheral surfaces a groove which extends parallel to the said principal surfaces and the groove walls of which extend at an angle in a manner such that the two principal surfaces of each plate each terminate in a wedge-shaped peripheral portion along the edges, which panels have to be joined to each other in twos by means of two L-shaped sections of electrically conducting material of which the ends of both legs are provided with a groove whose cross sectional shape is matched to the shape of the said wedge-shaped peripheral portions, the said wedge-shaped peripheral portions of the panels being pushed into the grooves in the ends of the legs of two suitably dimensioned L-shaped sections to produce the joint between two panels and the panels subsequently being pressed with predetermined force into the said grooves in the L-shaped sections.

The use of wedge-shaped joints produces a stable, rigid structure and a good leak-free contact is obtained between the electrically conducting layers and the L-shaped sections.

It is pointed out that the use of wedge joints is already known per se, for example, from U.S. Pat. Nos. 3,190,408 and 3,246, 072.

In U.S. Pat. No. 3,190,408, use is made of a separate wedge section which is pressed together with the panel edge into a groove of a joining strip. The double-walled corner joint shown in FIG. 7 of the said publication makes use of an integrally shaped corner strip with which separate panels can be assembled at a distance from one another. The design is not suitable for forming a double Faraday cage.

In U.S. Pat. No. 3,246,072, mention is made of a single wedge joint positioned on the center line of the core of the panels, further attachment means being necessary to secure a wedge joint which has been made.

A preferred embodiment of the joining system according to the invention is characterized in that the L-shaped sections, designed to form a corner joint two at a time, are coupled to each other via a spacing piece of electrically non-conducting material, the dimensioning of the spacing piece being such that the mutual spacing between the sections corresponds to the thickness of each panel.

Joining the two L-shaped sections involved in a corner joint to each other via a core piece of electrically non-conducting and preferably, thermally insulating material simplifies the assembly still further.

A further preferred embodiment of the joining system according to the invention is characterized in that the panels are provided around the core with peripheral strips adjacent thereto in which the said groove is provided, which peripheral strips are manufactured from a material having a predetermined coefficient of friction such that, after pressing in the wedge-shaped peripheral portions of the panels, a positive adhesive joint to the said sections is achieved.

Using the separate peripheral strips makes it possible, on the one hand, to choose for the core material having ideal properties in relation to, for example, thermal insulation and weight, a material being chosen, on the other hand, for the peripheral strips which has, for example, a high coefficient of friction and high creepage strength, for example a low-alkali glass fiber-reinforced polyester plastic.

A further preferred embodiment of the joint according to the invention is characterized in that, in the case of a box-like housing, the sections situated on the outside near the corner points of the housing are joined to one another via corner point parts of electrically conducting material.

Although the corner point parts are not strictly necessary for assembling the housing, they are necessary to provide the necessary points of application for moving, transporting, lifting, etc. the shelter. In addition, they contribute to the complete closure of the Faraday cage and naturally ultimately provide reliable securing of the entire structure.

The invention will be explained below in more detail with reference to the accompany figures in which an exemplary embodiment of a shelter constructed in accordance with the principles of the invention is shown in more detail.

Figure 1:
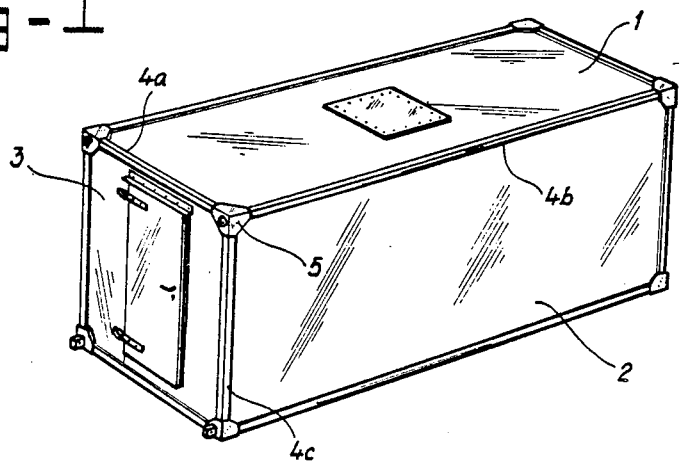
FIG. 1 shows a perspective view of a box-like housing.
Figure 2:
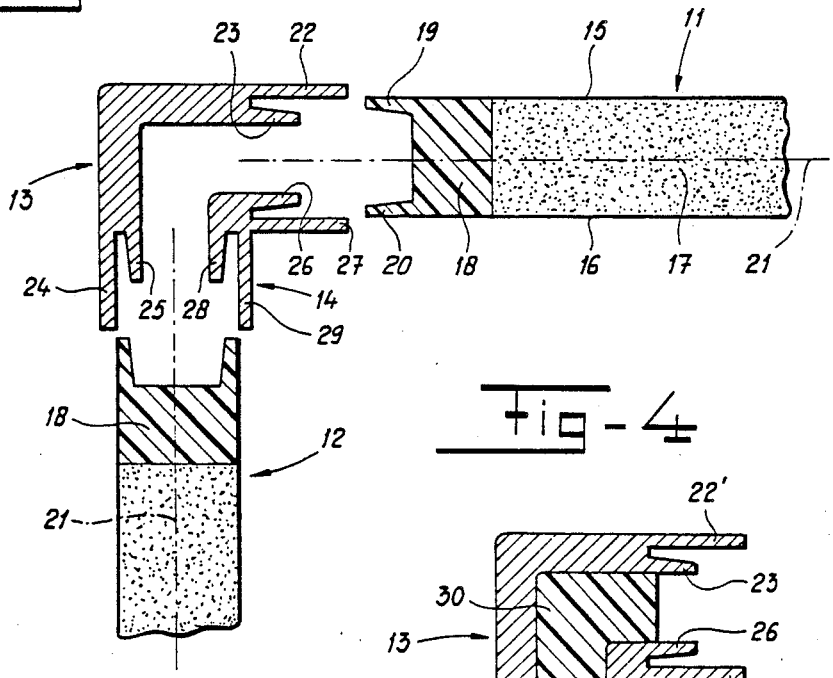
FIG. 2 illustrates in detail the joining system of the panels.

FIG. 2 shows a perspective view of a box-like housing (shelter) constructed from six wall panels times twelve frame sections and eight corner pieces. The wall panels of which only three, indicated by 1, 2 and 3, are visible in FIG. 1 are constructed as undivided panels, in other words, each panel occupies a complete wall surface. If necessary, doors, lead-through openings and the like can be provided in a number of panels, as is indicated in the figure, but this is not of importance in relation to the invention.

The wall panels are coupled to one another by means of 12 internal and 12 external L-shaped frame sections. Of these frame sections, only three are mentioned in particular in FIG. 1, namely the frame sections 4*a*, 4*b* and 4*c* with which the panels 1, 2 and 3 are attached to one another. In the corner point where the frame sections 4*a*, 4*b'* and 4*c* come together there is one of the eight corner pieces, indicated by 5. These corner pieces are provided with diagrammatically indicated elements for enabling the cabin or shelter to be transported, lifted, etc. as a whole.

Figure 3:
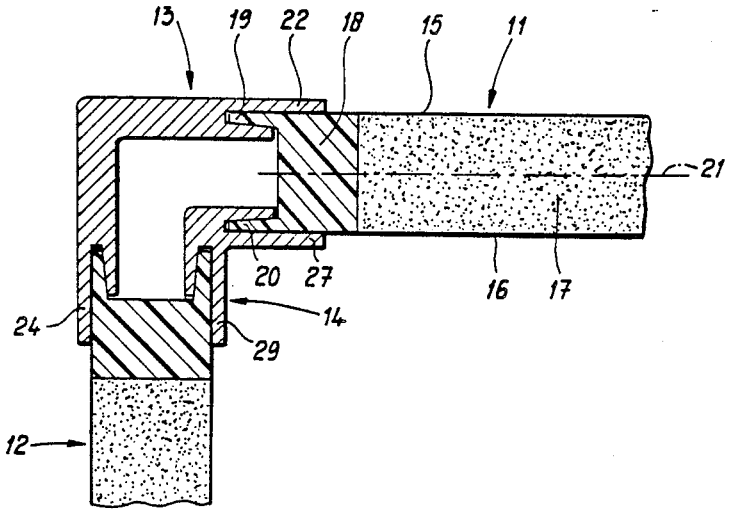
FIG. 3 illustrates the assembled corner section in FIG. 2.

FIGS. 2 and 3 show more details of the joining system which is used to attach the panels to one another with the aid of the L-shaped frame sections in a manner such that the box-like shelter structure is obtained. FIGS. 2 and 3 shown detail cross sections through the edge portions of two panels 11 and 12 which are joined to each other at a corner by two frame sections 13 and 14. FIG. 2 shows the situation prior to assembly, while FIG. 3 shows the situation in which the two panels 11 and 12 are coupled to each other via the sections 13 and 14.

In this exemplary embodiment, the panel 11 is composed of two light-metal plates 15 and 16 which are bonded to a core 17, for example, of hard foamed polyurethane. Provided along the edges of said core 17 is a framing strip 18, which framing strip has a fork-like profile which is to be described in still further detail. Said framing strip 18 is, for example, manufactured from a solid plastic such as nylon. The plates 15 and 16 may be bonded to the core 17 with a suitable type of adhesive such as Redux 609 or AV119. This adhesive, which is known to the person skilled in the art, can also be used to attach the framing strip 18 both to the core 17 and to the light-metal plates 15 and 16. The bonded joints are not shown with separate reference numerals in FIGS. 2 and 3. The production of such bonded joints is considered to be within the scope of the person skilled in the art.

As already state, the framing strip 18 is constructed with a fork-like cross sectional profile by providing a groove with sloping walls in the outwardly facing side edge. Two outwardly projecting, wedge-shaped parts 19 and 20 have been produced by shaping said groove, which parts are used, in a manner to be described in still further detail, for the actual assembly of the panel. The entire panel 11 is symmetrical with respect to the center line 21. The use of symmetrical panels is clearly to be preferred on the basis of production-engineering considerations.

Although it is not indicated in the figures in detail, it will be clear that the panel 12 is constructed in an identical manner from light-metal plates with a core situated in between and a grooved framing strip, which components are assembled to form a panel by means of bonded joints.

FIG. 2 further illustrates the sections 13 and 14 already mentioned which are constructed of a conducting material and are obtained preferably by means of extrusion from light metal. Both sections 13 and 14 are composed essentially of angled L-shaped profiles in which a groove is provided in both legs in the longitudinal direction of the leg concerned. Providing the said grooves produces fork-shaped edges with two feet. In FIG. 2, the groove in the horizontal leg of the section 13 results in the production of the feet 22 and 23, while providing the groove in the vertical leg has resulted in the formation of the feet 24 and 25. It is pointed out that the feet 23 and 25 are chamfered on the inside and, in particular, at an angle which is equal to the sloping position of the feet 19 and 20 on the framing strip 18 of the panel 11 or 12 respectively. The feet 22 and 24 are furthermore kept longer than the feet 23 and 25. The purpose thereof will be explained in still further detail.

The framing section 14 is shaped virtually in the same manner, with the exception of the fact that the dimensions have been chosen in a manner such that, as is evident from FIG. 2, the forked legs with the forked feet 26, 27, 28 and 29 are situated at the correct position to be capable of acting on the respective feet along the edges of the panels 11 and 12.

It will be clear that the assembled structure of FIG. 3 can be achieved by pressing that feet 19 and 20 into the respective fork-shaped recesses at the ends of the legs of the sections 13 and 14.

During the assembly, which ultimately leads to the result which is illustrated in FIG. 3, the panels 11 and 12 are pushed with a predetermined force into the fork-shaped ends of the sections 13 and 14. This achieves the following result:

(1) A clamping joint is produced between the wedge-shaped parts 19 and 20 and the respective fork feet of the sections 13 and 14. Said clamping joint is so strong that it is possible to construct a complete box-like housing or shelter in this manner without further attachment means. In other words, no further bonded joints, blind rivet joints, bolt joints and the like are necessary to actually achieve the desired result. There is no metallic contact between the outermost and innermost L-shaped sections as a result of which the inside wall and outside wall are thermally insulated from each other even at the corners of the shelter. As a result of the insulation, the temperature of the interior is less influenced by the external conditions.

(2) An intimate metallic contact is produced between the metal outside cladding of the panels 11 and 12 and the outermost metal fork feet of the sections 13 and 14. In order to improve said metallic contact still further, the feet 22, 24, 27 and 29 are of relatively long construction so that a relatively large contact surface is obtained, which ensures that the Faraday cage structure is completely sealed. Because a very intimate metallic contact is obtained in this manner, it is not necessary, as was usual in the prior art, to use additional blind rivets or a metallically conducting paste in order to arrive at a well-closing Faraday cage. In addition, a double Faraday cage is obtained in this manner.

(3) Using the forked legs on the sections 13 and 14 produces a labyrinth for high-frequency energy in the case of each of said forked ends after assembly, which achieves very good attenuation of said energy, which might nevertheless still leak through any small irregularities despite the excellent abovementioned metallic joint.

(4) There is no metallic contact between the outermost and innermost L-shaped sections, as a result of which the inside wall and the outside wall are thermally insulated from each other even at the corners of the shelter. As a result of the insulation, the temperature of the interior is less affected by the environment.

Figure 4:
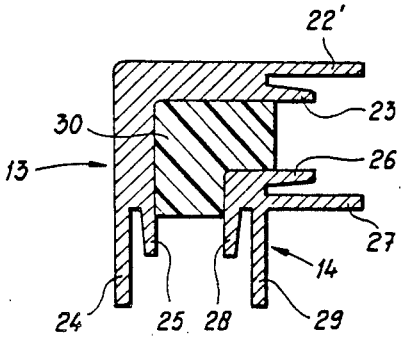
FIG. 4 shows a modified embodiment of an assembled corner section.
Figure 5:
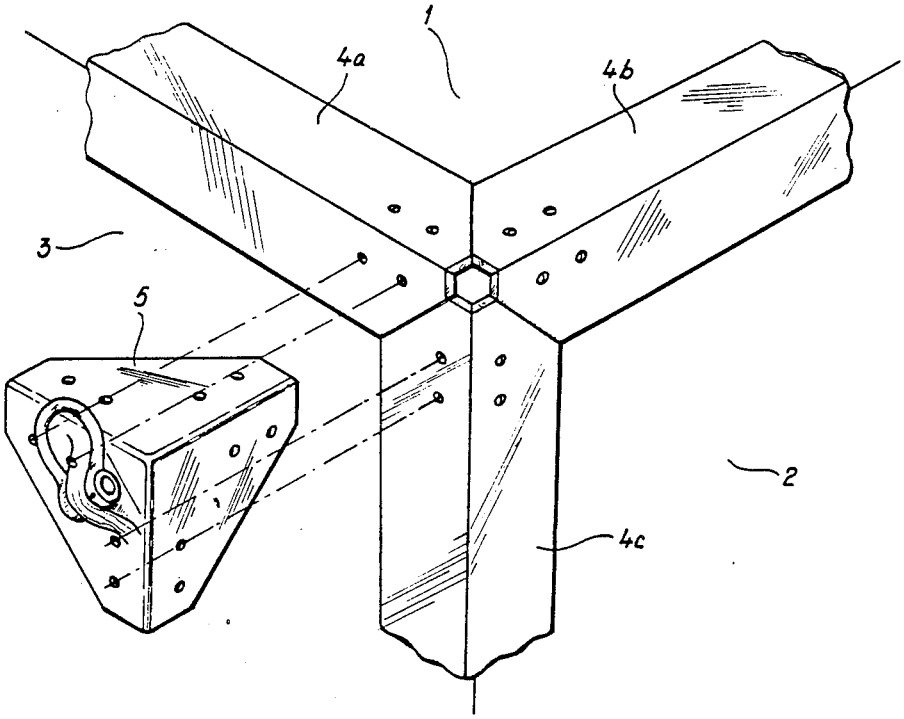
FIG. 5 illustrates a detailed view of one of the corner points of the housing.

After the entire box-like construction has been achieved by simply pressing in the panels and frame sections, to secure the structure and also for the transport purposes already mentioned, so-called corner fittings are mounted at the eight corner points, for example, by means of bolts which are screwed in up to the outermost frame sections 13. It will be clear that the outermost frame sections 13 are thereby coupled to form a closed outside peripheral frame, while the Faraday cage structure is also completely sealed at the corner points. To additionally secure the clamping joint of the wedge-shaped parts, the oppositely situated innermost L-shaped sections and also the oppositely situated outermost L-shaped sections should be joined with binding stays. They can also be secure by providing a few bolts distributed over the length of the L-shaped section between the section and the plastic framing strip 18. In FIG. 5 the center lines of such bolts are indicated by phantom lines. FIG. 4 shows a modified embodiment in which the sections 13 and 14 are joined to each other via a core 30 of electrically non-conducting and preferably, thermally insulating material. Using such an assembled corner section simplifies the assembly still further.

Tests carried out with a shelter constructed in this manner have shown that shelters which are able to meet all requirements which are standard at the present time as regards point loading, edge loading, drop loading under various conditions and the like can be created by using this joining system.

FIG. 5 shows a detailed view of one of the corner points of the shelter. This figure speaks for itself and requires no further explanation.

I claim

1. A joining system for joining six wall panels to form a box-like housing such as a shelter, each panel having a rectangular flat shape and comprising a core of electrically non-conducting material bounded at the four edges by bifurcated edge sections and metal plates or layers bonded to said core and forming the inner and outer wall surfaces of the housing after joining the six panels, said bifurcated edge sections providing a groove in each edge, said grooves having groove walls and said groove walls extending at an angle in a manner such that each leg of the edge section together with the thereto bonded part of the respective metal plate or layer forms a wedge-shaped peripheral portion along the respective edge of the panel, the system furthermore comprising L-shaped frame sections of electrically conducting material of which the ends of both legs are provided with a groove whose cross-sectional shape is matched to the shape of the said wedge-shaped peripheral portions, said wall panels and said L-shaped frame sections being configured and dimensioned to be assembled in a box-like housing by positioning the wedge-shaped peripheral portions on each edge of the panels into the grooves in the ends of the legs of two of said L-shaped frame sections to obtain the general shape of the box-like housing and for the joints between the panel edges and the respective frame sections to be established by pressing each panel edge with force into the grooves of the respective L-shaped frame sections forming a rigid, continuous-contact joint.

2. A joining system according to claim 1, wherein the two L-shaped frame sections, destined to form a corner joint between two wall panels, are coupled to each other via a spacing piece of electrically non-conducting material, the dimensioning of the spacing piece being such that the mutual spacing between the frame sections corresponds to the thickness of each wall panel.

3. A joining system according to claim 1, wherein the assembled box-like housing is secured by joining the ends of the L-shaped frame sections meeting each other at the corners of the housing via corner point parts of electrically conducting material.

4. A joining system according to claim 1, wherein the panels are provided around the core with peripheral strips adjacent thereto in which said groove is provided, which peripheral strips are manufactured from a material having a predetermined coefficient of friction such that, by pressing in the wedge-shaped peripheral portions of the panels, a positive adhesive joint to the said sections is achieved.

5. An apparatus for forming a double Faraday cage housing comprising:

(a) rectangular flat panels each having two principal surfaces and four edges, each of said panels comprising:
  (i) a rectangular core of stiff insulating material having two principal surfaces and four edges;
  (ii) framing strips along all four edges, said framing strips having two wedge shaped projections defining a central slot, said framing strips comprising a solid plastic; and
  (iii) two light-metal rectangular plates, one on each principal surface of said rectangular core dimensioned, and configured to be coterminous with said projections of said framing strips and bonded to said rectangular core and framing strips;

(b) external frame sections having an L-shape cross section having two legs forming said L-shape, each of said two legs having two feet defining a groove, said groove configured and dimensioned to matingly engage with one of said wedge shaped projections of said framing strips forming a tight clamping joint, said external frame sections being comprised of metal; and (c) internal frame sections having an L-shape cross section having two legs forming said L-shape, each of said two legs having two feet defining a groove, said groove configured and dimensioned to matingly engage with one of said wedge shaped projections of said framing strips forming a tight clamping joint, said internal frame sections being comprised of metal, said wedge-shaped projections of said framing strips, said legs and feet of said external frame sections and said legs and feet of said internal frame sections being configured, dimensioned and positioned such that said two of said panels may be engaged with one of said internal frame sections and one of said external frame sections forming continuous tight clamping joints with both of said two of said panels, and said internal frame section remaining separated and insulated from said external frame section.

6. Apparatus as in claim 5, further comprising electrically non-conducting spacers between said interior frame sections and said exterior frame sections.

7. Apparatus as in claim 5, further comprising corner sections of electrically conducting material forming a cover for the intersection of three exterior frame sections.

8. Apparatus as in claim 7, combined to form a double Faraday cage comprising:

(a) six of said rectangular flat panels;

(b) twelve of said exterior L-shaped frame-sections;

(c) twelve of said interior L-shaped frame-sections; and (d) eight of said corner sections wherein said rectangular flat panels are configured, dimensioned and positioned to form a six-sided housing joined at the edges by said exterior frame sections and said interior frame sections forming a continuous conducting interior surface and a continuous conducting exterior surface.

9. Continuous conducting joint for a double Faraday cage comprising:

(a) two panels, each of said panels comprising:

(i) a rectangular core of stiff insulating material having two principal surfaces and four edges;

(ii) framing strips along all four edges, said framing strips having two wedge shaped projections defining a central slot, said framing strips comprising a solid plastic; and (iii) two light-metal rectangular plates, one on each principal surface of said rectangular core, dimensioned and configured to be coterminous with said projections of said framing strips and bonded to said rectangular core and framing strips;

(b) an external frame section having an L-shape cross section having two legs forming said L-shape, each of said two legs having two feet defining a groove, said groove configured and dimensioned to matingly engage with one of said wedge shaped projections of said framing strips forming a tight clamping joint, said external frame sections being comprised of metal; and (c) an internal frame section having an L-shape cross section having two legs forming said L-shape, each of said two legs having two feet defining a groove, said groove configured and dimensioned to matingly engage with one of said wedge shaped projections of said framing strips forming a tight clamping joint, said internal frame sections being comprised of metal, said wedge-shaped projections of said framing strips, said legs and feet of said external frame sections and said legs and feet of said internal frame sections configured, dimensioned and positioned such that said two of said panels may be engaged with both one of said internal frame sections and one of said external frame sections forming electrically continuous, tight self-maintaining joints with both, and said internal frame section remains separated and insulated from said external frame section.

* * * * *